United States Patent [19]

Chill et al.

[11] 4,243,437

[45] Jan. 6, 1981

[54] PROCESS FOR FORMING ARTICLES FROM LEADED BRONZES

[75] Inventors: James L. Chill; Harry H. Taylor; Evertt H. Granger, all of Marion, Ohio

[73] Assignee: Marion Bronze Company, Marion, Ohio

[21] Appl. No.: 962,397

[22] Filed: Nov. 20, 1978

Related U.S. Application Data

[63] Continuation-in-part of Ser. No. 702,286, Jul. 2, 1976.

[51] Int. Cl.[3] ..... C22F 1/08

[52] U.S. Cl. ..... 148/11.5 C; 148/12.7 C

[58] Field of Search ..... 148/11.5 C, 12.7 C, 148/2; 75/156, 156.5

[56] References Cited

U.S. PATENT DOCUMENTS

| | | | |
|---|---|---|---|
| 2,802,733 | 8/1957 | Bungardt | 75/156.5 |
| 2,804,408 | 8/1957 | Gregory | 148/11.5 C |

*Primary Examiner*—L. Dewayne Rutledge
*Assistant Examiner*—Peter K. Skiff

[57] ABSTRACT

A process is provided for the forming of articles from leaded bronzes of copper alloy base having a lead content of at least 4% and which process includes cold working, in the forming of products or articles, and specifically the forming of bearings. Basically, the process of this invention comprises the forming of stock by chill casting techniques and the subsequent alternate steps of cold working and annealing the chill cast stock of predetermined configuration in forming of a substantially finished product or article having predetermined dimensions and configurations. The alloy is first chill cast into stock of predetermined configuration and is then subjected to cold working to effect a predetermined dimensional reduction in forming of the desired article. Annealing is accomplished between cold working operations which may include more than one pass through the cold working apparatus to obtain a predetermined reduction prior to an annealing operation. Also, the chill cast stock may be subjected to an annealing operation prior to the first cold working operations. Utilization of this process results in enhancement of the grain structure of these materials which are initially formed by chill casting procedures as well as effecting a significant increase in the tensile strength and hardness properties of such materials.

11 Claims, 10 Drawing Figures

PROCESS FOR FORMING ARTICLES FROM LEADED BRONZES

CROSS REFERENCES

This application is a continuation-in-part of copending U.S. application Ser. No. 702,286 filed July 2, 1976.

BACKGROUND OF THE INVENTION

This novel process for cold working of copper alloyed materials having a relatively high lead content, of the order of at least 5%, has specific application in the fabrication of bearings and bearing bushings. While the specification and drawings are directed to and are specifically illustrative of this specific application, it will be understood that the cold working method of this invention can also be advantageously utilized in fabrication of other products or with other materials having similar characteristics.

Materials generally utilized for bearings or bearing bushings are copper alloys, generally termed bronzes. These alloys have copper as their major constituent but include significant amounts of other metallic elements. The most common alloys generally utilized to form bearings include significant amounts of lead, along with other metals such as tin, zinc and nickel, and are designated as leaded bronze. A distinct advantage of the copper-lead combination is that the lead imparts self-lubricative properties which enable bearings formed from such materials to operate in situations where external lubrication may not be continually assured. The primary disadvantages of the leaded bronze are that these alloys characteristically have tensile strengths and hardness properties which are inadequate for many bearing applications because of their limited load carrying capability. The most widely utilized leaded bronzes that are currently commercially available, with such an exemplary material being designated SAE 660 in the commercially accepted identification scheme have tensile strengths in the range of 25,000–45,000 P.S.I. and a hardness number in the range of 50–70 on the Brinell scale with a 500 kilogram load. These properties are obtained with the materials as cast which is the common condition for fabrication by the conventional machining operations since these materials have generally been considered unworkable by any conventionally known mechanical working techniques.

To accommodate more stringent bearing requirements and lead specifications for substantially greater tensile strength and hardness properties, copper alloys have been formulated with aluminum as the additional constituent of significant proportion. These copper-aluminum alloys do not include lead, and are not inherently self-lubricative. However, these copper-aluminum alloys do have substantially greater tensile strength and hardness thereby enabling bearings fabricated from these materials to withstand greatly increased loads. Such copper-aluminum alloys usually have tensile strengths of the order of 90,000 P.S.I. and a Brinell hardness of the order of 195 on the same Brinell scale as the leaded bronzes.

Enhancement of bronze materials properties has been proposed by addition of substantially significant quantities of tin. Exemplary of such proposals in U.S. Pat. No. 2,804,408 granted to Hardy E. Gregory on Aug. 7, 1957. Gregory discloses additional tin in proportions of up to 12% while the lead content remains low such as the order of 1%. Clearly, utilizing high proportions of tin provides enhancement of the alloy's structural strength characteristics but Gregory's disclosure is not remotely suggestive of using lead to enhance those properties with the disclosed processing technique.

As previously indicated, the leaded bronze type copper alloys are initially cast by various well known casting techniques. These techniques include the newer centrifugal and continuous casting as well as sand and permanent mold casting. The castings thus formed were then finished into a desired article, such as bearing bushing, by relatively costly machining operations in view of the generally accepted belief that these leaded bronze materials were mechanically unworkable by conventional rolling and forging procedures. These leaded bronzes cannot be hot worked because of the low melting point of the lead and other constituents that are included. Specifically, lead in the preferably significantly large proportions proposed by this invention liquefies at the temperature where the copper can be hot worked and lead, when liquefied, may pass out of or otherwise be lost from the material along with other low melting point constituents. Since hot working is prohibited by the low melting points of some of the lead and other constituents, it has generally been impractical to mechanically work the material utilizing normal rolling operations. Previous attempts at cold rolling have been restricted to relatively small dimensional reductions or changes in configuration as these materials tend to readily fracture when cold worked. Attempts at working of these materials beyond a predetermined limit generally results in fracturing of the material or separation of the various constituents. Although cold working increases the hardness of the material, this increase in hardness further increases the likelihood of the material to fracture.

In addition to the cost of the prior casting and machining operations for forming of bearing bushings, the bushings thus fabricated were limited to effectively have only the properties of tensile strength and hardness of the specific alloy as cast. As previously indicated, the materials available for fabrication of bearings are either of the leaded bronze or the aluminum bronze types and each type has its own respective strength and hardness properties. Consequently, selection of materials for bearings is limited to those having the customary formulations with the strength and hardness properties of the bearings fabricated therefrom being limited accordingly. It is not possible to alter the material compositions to the extent necessary to obtain different properties and, therefore, no bearing materials are reasonably available having strength and hardness properties intermediate the two widely separated ranges for the exemplary materials.

SUMMARY OF THE INVENTION

In the practice of cold working copper-alloyed, leaded bronzes by the process of this invention, it is now possible, as well as economically feasible, to produce articles of leaded bronze having tensile strength and hardness properties that are greatly increased over that of the bronzes which were previously available. Enhancement of these properties is obtained through practice of this inventive method which basically comprises the alternate cold working and annealing of chill cast stock which may be in plate or bar form. Alternate cold working and annealing steps may be repeated several times to obtain a desired reduction in thickness dimension of a plate or bar stock and achieve a desired increase in the tensile strength and hardness properties as well as forming the stock into an article of desired configuration. Another advantageous and extremely important result concurrently obtained by the alternating cold working and annealing operations is the improved grain structure over the as-cast structure present in the cast and machined type of bearing fabrication.

In practicing the process of this invention for forming of articles from leaded bronzes, the copper alloy material is first formed by a casting operation into stock of predetermined size and configuration. This stock may be of a plate of bar form or it may be in a more complex configuration that may more closely approximate the ultimately desired article configuration. The casting technique that is utilized is chill casting wherein molten alloy is either poured into a static mold of a selected type, or it may be cast as a continuous stock element which is then cut to desired lengths. Employment of chill casting techniques, whether of a static mold or continuous cast type, also includes a controlled rate of solidification through control of the chilling of the material in either the static mold or as it is drawn from a continuous casting machine. Utilization of the chill casting technique results in a material having a more continuous or homogeneous matrix of the leaded bronze having the specifically enhanced properties of strength and malleability for enabling the material to be subjected to the subsequent mechanical working and annealing processes. It is important that a chill casting technique be utilized in forming of the stock as a sand-cast technique is generally incapable of being controlled as to the rate of chilling to effect the desired formation of crystaline structure that enables the material to be best formed in accordance with the techniques of this invention.

In accordance with the second aspect of the process of this invention, the chill cast stock whether in plate or bar form, or specific article configuration, is alternately subjected to cold working, such as by a rolling operation, and to an annealing process in which the article is subjected to predetermined temperature for a prescribed period of time. Cold working is accomplished to an extent to effect a predetermined reduction in the physical dimension of the stock with this working concurrently producing an improved grain structure along with an increase in the tensile strength and hardness properties. After cold working the stock to the predetermined extent, the stock is subjected to an annealing process which lowers the hardness thereby returning the material to a sufficiently ductile and malleable state as to enable the material to be capable of further cold working. The extent of cold working, measured in terms of amount of dimension reduction, is coordinated with the temperature elevation and length of time during which the stock is subjected to the annealing temperature to control the crystalization of the material and attain the desired increase in tensile strength and hardness. Alternate cold working and annealing operations are repeated for a predetermined number of cycles determined necessary to achieve a desired ultimate dimensional reduction that, ideally, closely approximates the finished dimensions of the article thereby at least minimizing, if not entirely eliminating, the relatively costly machining operations that may otherwise be necessary. This procedure control is also effective in obtaining an article, such as a bearing, having the substantially enhanced strength and hardness properties necessary for the beneficial use of the particular article.

The process of this invention is applied to particular advantage in the forming of bearings of cylindrical configuration. Cold working and alternate annealing operations may be initially carried out on flat plate stock that is chill cast with the final working resulting in forming of a cylinder from the flat plate. This final working is coordinated to attain the specified strength and hardness properties in the finished article having a specified configuration of predetermined dimension. A cylindrical tube when thus formed by this technique, may have its axial seam welded prior to performing any necessary finish machining operation to obtain the precise diametrical and length dimensions and to smooth the seam surface. Cast bar stock, or specifically configured blanks, may also be subjected to the alternate cold working and annealing operations in accordance with this invention to achieve the advantageous results of enhanced properties of strength, hardness and strain structure for many varied articles.

A further aspect of this invention involves the utilization of a die-stamping operation following the rolling type cold working step and alternating annealing steps. The rolling cold working and annealing steps place the leaded bronze in a state where it is susceptible to being die-stamped thereby resulting in economy of fabrication for certain specific articles utilizing materials having the enhanced properties and characteristics.

A still further economic advantage obtained through utilization of this inventive process in that a material having the specified strength characteristics can be obtained but in which the relatively low cost lead can be substituted for the more expensive tin that is otherwise required in such materials. This substitution can effect a substantial savings in cost of raw materials.

These and other objects and advantages of this invention will be readily apparent from the following detailed description of an illustrative process and apparatus for the performance of the process. Exemplary apparatus for the performance of this process is the production of copper alloy articles is illustrated in the accompanying drawings.

DESCRIPTION OF THE DRAWING FIGURES

DETAILED DESCRIPTION OF THE ILLUSTRATIVE PROCESS

The process of this invention includes as a first step in the forming of articles from leaded bronze, the casting of a particular selected copper-based alloy by a technique which is commonly known as chill casting. Chill casting techniques are well known and include the two different techniques diagrammatically illustrated in FIGS. 1 and 2. Either of these two techniques may be utilized in the practice of this invention and it will be understood that this invention is not limited to the illustrative apparatus and techniques.

Figure 1:
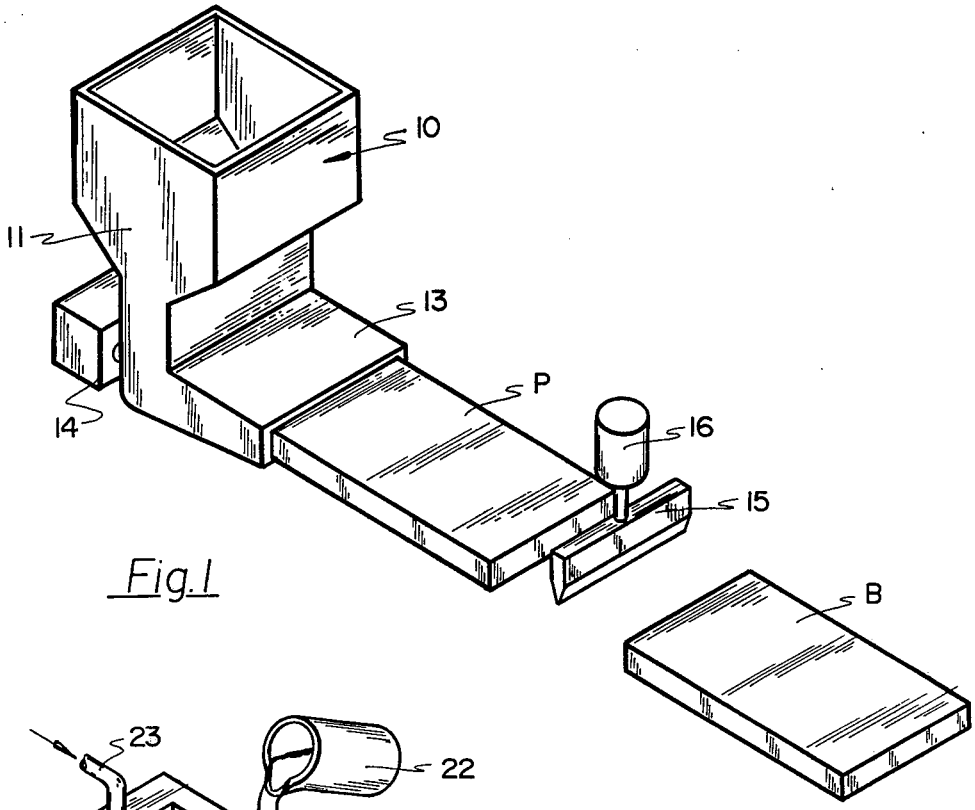
FIG. 1 is a diagrammatic perspective view of a continuous chill casting apparatus.

Referring specifically to FIG. 1, a continuous type casting technique is illustrated wherein a continuous casting apparatus, designated generally by the numeral 10, a diagrammatically shown for producing a continuous plate P. This apparatus includes a supply reservoir 11 containing the alloy in a molten state which feeds by gravity through a throat 12 and then out through a discharge orifice 13. The apparatus is specifically shown as configured to produce a flat bar of rectangular cross-section with the bar having specific width and thickness dimensions to meet the requirements in forming of a particular article. Differently configured discharge orifices would be designed and utilized to produce specific stock configurations as deemed appropriate.

Specifics of construction and operation of a continuous casting apparatus of this type are well known and need not be further described other than to also point out that the apparatus conventionally utilizes an ejector mechanism generally indicated at 14 for controlling the discharge of the molten alloy to effect a predetermined rate of discharge through the orifice 13. The function of this controlled rate of discharge is to maintain a specified rate of cooling. A controlled rate of cooling is essential in the formation of the leaded bronzes with which this process is concerned as the grain size of the copper based alloy and of the lead particles, or globules, are thus better controlled within predetermined limits. It is preferred that the process of casting the alloy be conducted in such a manner that the copper-based alloy will form a matrix that is of a more homogeneous nature and effects a more uniform distribution of the lead globules throughout this matrix with it being noted that the lead does not go into solution with the copper based alloy but remains as particles distributed in diverse and randomly dispersed patterns throughout the alloy in either the molten or solidified states.

Subsequent to the discharge of the solidified, continuous bar P from the casting apparatus 10, a cutting mechanism illustrated as including an elongated cutting blade 15 is operated to sever the continuous bar P into stock S of predetermined length. This cutting blade 15 is shown as supported by and actuated by an operating mechanism generally indicated at 16 which may be of a hydraulic ram type.

Figure 2:
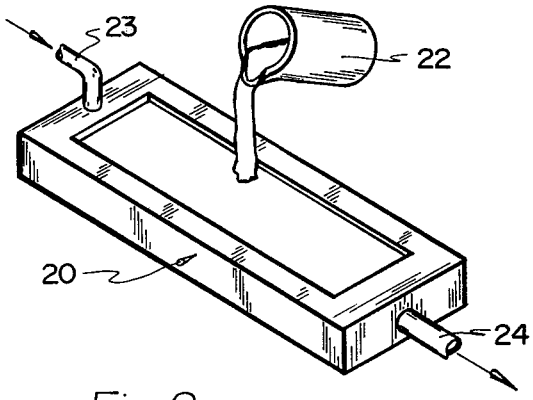
FIG. 2 is a diagrammatic perspective view of a static mold chill casting apparatus.

The second type of chill casting illustrated is shown in FIG. 2 and comprises a static mold 20 which includes a central cavity 21. It is this cavity 21 which receives the molten copper-based alloy and lead composition from a suitable ladle 22 in which the materials were reduced to a molten and pourable state. Once the alloy and lead composition has been poured into the cavity 21, the cooling process is initiated and can be effectively controlled by the passage of an appropriate fluid coolant through internally formed chambers (not shown) that surround the cavity 21. This fluid coolant is caused to enter at an inlet conduit 23 and is subsequently discharged at a conduit 24 for subsequent recycling. By controlling the rate of flow and the inlet temperature of the coolant, it is possible to precisely control the rate of cooling and thus represents a chill casting technique that is appropriate for obtaining cast stock of predetermined dimensions for the practice of this invention in forming articles from leaded bronzes. As indicated previously with the continuous casting technique, the rate of cooling is controlled to obtain a desired or preferred matrix configuration of the copper based alloy as well as the preferred size of lead particles or globules which are randomly distributed or dispersed throughout this matrix.

Figure 3:
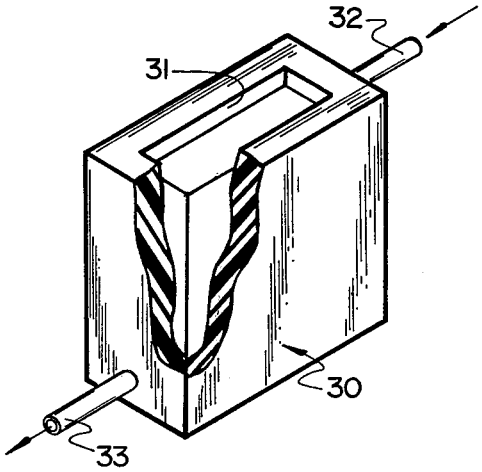
FIG. 3 is a diagrammatic perspective view of a modified static mold chill casting apparatus.

FIG. 3 illustrates a modified static-mold chill casting apertures. The apparatus in FIG. 3 is an upright type mold 30 in which a cavity 31 is formed for receiving the molten copper-based alloy and lead compositions for solidification. The mold 30 is of a type having a number of internally formed chambers interconnected with an inlet conduit 32 and outlet conduit 33 for passage of a fluid coolant through those chambers. As in the case of the static mold shown in FIG. 2, the rate of coolant flow, as well as its inlet temperature, are controlled to effect chilling of the poured alloy and lead composition at a predetermined rate to achieve the desired and preferred matrix configuration and lead particle size and their distribution in that matrix.

Although FIGS. 1, 2 and 3 illustrate chill casting techniques that are designed primarily for the production of stock in the form of flat plates or bars of rectangular cross-section and of predetermined length, it will be understood that the technique and process is not considered to be so limited. It will be readily apparent that, either a continuous casting apparatus of FIG. 1 or the static mold casting apparatus of the types shown in FIGS. 2 and 3, may be constructed for the production of stock which may have a substantial similarity to the ultimately desired configuration and dimensions of a finished article. For example, it is possible that the stock may be formed in an enlongated bar having a substantially modified cross-sectional configuration which may be of an L and T shape to more closely approximate the cross-section of a finished article. Also, it is possible that the case stock may have an even more complex configuration but still be susceptible to processing in accordance with this inventive process by alternate cold working and annealing steps which are necessary in the formation of the articles of leaded bronze having the further and greatly enhanced characteristics such as hardness and structural strength while retaining the advantageous lubrication properties inherent through the inclusion of a substantially large proportion of lead in the homogeneous mixture of the alloy.

One typical leaded bronze material comprising a copper based alloy which is suitable for fabrication of bearings in accordance with the principles of this invention, is identified by the standard designation SAE660 with copper being the primary constituent and included in the proportion of 81 to 85 percent. This particular leaded bronze includes, in addition to the primary lead component of 7%, other constituents such as tin and zinc. These latter elements are included in proportions to total 100 percent with it being recognized that certain other impurities or other elements in minor amounts may also be included and constitute approximately 1% or less of the total with these other elements possibly including nickel, iron, phosphorus and antimony. Leaded bronzes selected for utilization and formation of articles therefrom, in accordance with this invention, have a lead content preferably at least of the order of 4% and may advantageously exceed this by several percent approaching a maximum lead content in the range of 10–12%. This amount of lead provides the necessary amount of lead for enabling the increase and enhancement of the properties of a resultant high-leaded bronze whether it is to be utilized as a bearing element or as some other type of structure for diverse purposes. The objective for the inclusion of lead in such large proportion is not only for obtaining superior lubricating qualities in bearings to assure continued lubrication in the event that petroleum-type lubricants are either unavailable at certain times or are inappropriate for operation of a specific type of bearing. The objectives are to also enable the characteristics and properties of the leaded bronze to be modified by this process to meet particular specifications.

Specific physical properties of a leaded bronze alloy that are of importance for bearings are strength and hardness. In the case of a particular illustrative alloy, SAE660, these two properties have nominal values in an "as cast" condition of 35,000 P.S.I. tensile strength and a hardness of 65, the latter being a Brinell hardness number for a 500 kg. load. Other leaded bronzes have similar physical properties which are within the range of 25,000–35,000 P.S.I. tensile strength and a Brinell hardness number in the range of 50–70. In accordance with prior bearing manufacturing practices, these properties remain essentially constant during bearing fabrication with the resultant bearings also having these same physical properties or characteristics. This fact is readily apparent upon considering that bearings have heretofore generally been fabricated by machining of a casting.

Figure 4:
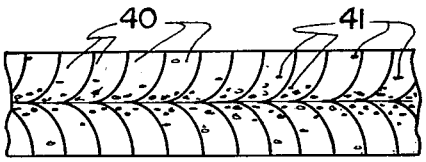
FIG. 4 is a diagrammatic cross-sectional view of an as-cast plate showing grain structure.

FIG. 4 of the drawings diagrammatically illustrates the internal structure of the chill cast stock as formed by a chill casting techniques. As illustrated in that diagram, which is appropriate for the continuous casting technique of FIG. 1 or the static mold of FIG. 3, the stock bar has a symmetrically formed matrix of relatively large copper alloy crystals 40 in which are included the globules or particles of lead 41 that are contained within the interstices of that matrix but retaining their separate identify. This illustration also indicates that the chilling or cooling is progressively inward from each of the exterior surfaces and thus forms a significant division line located centrally on the bar and extending longitudinally thereof. This characteristic of a center divisional line will not necessarily be present in stock cast in a static mold of the type shown in FIG. 2 although there would be a gradual variance in the crystal structure between the one large area surface formed in the bottom of the mold cavity in more direct contact with the coolant than the upper surface which was merely exposed to the atmosphere.

There are also differences in the resultant grain structure and lead particle distribution as between the continuous cast and static cast techniques. Continuous casting normally produces a more fine grained structure which is more dense and porosity free. A finer grain structure gives the material greater soundness and ability to withstand heavier loads including shock without deformation. Physical properties of hardness, tensile strength and yield strength increase with a finer grain structure. The lead distribution becomes more uniform and desirable for surface lubrication and wear qualities. There is also a lessor chance to encounter under surface defects.

The method of this invention enables fabrication of bearings, or other articles, from standard commercially available bronzes, but, through utilization of this process, results in the ability to increase the tensile strength and hardness properties of the as-cast stock regardless of the casting procedure. Utilization of this process can result in a substantial and significant increase of the strength and hardness of a basic SAE660 composition to values in the order of 60,000 P.S.I. and a Brinell hardness number of 140. Thus, bearings or other articles formed from a highly leaded bronze having physical properties of a magnitude in a region for which no materials are currently available can be readily fabricated by the use of cold working procedures whereby the need for relatively expensive machining procedures is at least minimized if not entirely eliminated in many instances.

Figure 5:
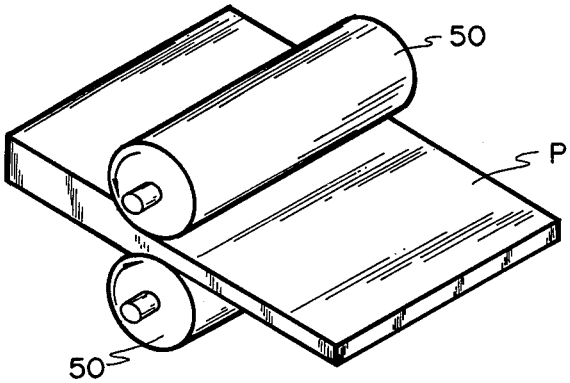
FIG. 5 is a diagrammatic illustration of rolling apparatus performing a cold rolling operation on a flat plate.

In accordance with this process, the copper based alloy, as cast in either plate or other suitable configuration, is subjected to alternate cold working and annealing operations. The cold working is diagrammatically illustrated in FIG. 5 of the drawings with a flat plate P being passed between two rolls 50 of a predetermined rolling apparatus. The rolling apparatus is operated with each pass designed to effect a reduction in thickness of the plate that is accompanied by an elongation of the plate without any significant increase in width. In usual cold working procedures, each pass between a set of the rolls 50 effects only a limited reduction of the stock with further reduction being achieved by either passing the stock between several sets of rolls with different spacing, or the stock may be passed between a set of rolls that may be relatively adjusted to sequentially decrease the spacing therebetween. Specifics of the mechanics to accomplish the cold working do not form a part of this invention and are sufficiently well known in the field as to not require any further explanation. It will be readily apparent that other apparatus may be utilized to effect cold working as deemed appropriate for a particular stock configuration or to obtain a particular substantially finished article configuration.

Figure 6:
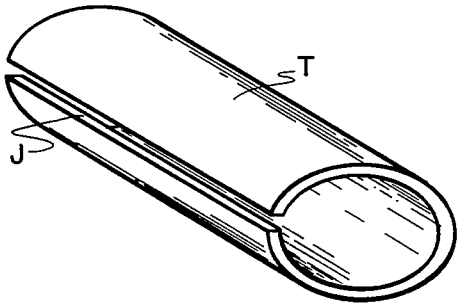
FIG. 6 is a perspective view of an elongated tube formed by this process.
Figure 7:
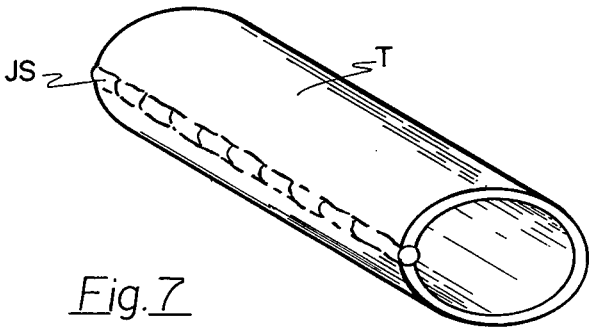
FIG. 7 is a perspective view of the tube of FIG. 6 having the longitudinal seam thereof welded.

By way of example, a plate-form stock P when reduced to its desired thickness, may then be further cold worked and rolled into a cylindrical tube T as shown in FIG. 6. This tube T then may be machined to the precise specified inside and outside diameters with the amount of machining kept at a minimum through accurate control of the cold-working thickness reduction. It will be readily apparent that the tube T may be accurately cut to obtain a unit of desired length and more than one such unit may be obtained from a particular tube depending on the relative lengths. If necessary, the axially extending juncture line J of the tube T may be welded as shown in FIG. 7. This welding forms a seam JS that does not materially affect the physical characteristics or properties of a tube of bearing formed in accordance with this process and the excess weld may be readily machined concurrently with the finish machining of the tube as previously described. Rolling of a plate into a tube in this manner is a convenient technique for fabrication of relatively large size bearings.

This example of tube or bearing fabrication is described as being illustrative of the fabrication techniques utilizing the method of this invention. It will be understood that other mechanical cold working techniques and procedures can be applied to the flat plate P or to stock that may be otherwise configured. This method, with appropriate selection of cold working procedures, may be readily applied to other shapes and configurations of stock.

Figure 8:
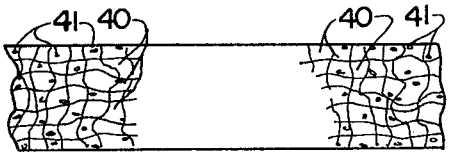
FIG. 8 is a diagrammatic cross-sectional view of the plate of FIG. 4 following processing in accordance with the invention and showing grain structure.

In accordance with this process, the cast stock S may be first subjected to a cold working step as by rolling to effect a first dimensional reduction in the thickness. The extent of reduction is limited by the fact that these copper-based alloys have a tendency to rupture or fracture if the mechanical distortion exceeds a certain amount. Working of the material as by cold rolling results in deformation and breaking up of the grains or crystals 40 of the alloy and redistribution of the lead particles 41 in the matrix of the alloy as well as tending to coalesce the smaller lead particles into relatively larger particles. This working also increases the tensile strength and hardness. Subsequent to cold working of the stock to a predetermined extent, and effecting a specific dimensional reduction, the stock is then annealed to reduce the hardness while improving the ductility. The annealing operation has the further advantageous result of recrystallization of the material into smaller grains. A resultant grain structure that may be attained at the conclusion of an annealing step is diagrammatically illustrated in FIG. 8. The grains of the copper based alloy are now relatively small crystals 42 with relatively larger lead particles 43 more uniformly distributed throughout the plate.

Upon completing a cold working step with a subsequent annealing step, the stock may then be subjected to another cold working operation followed by another annealing step. These alternate cold working and annealing steps are repeated as deemed necessary to achieve the desired grain structure and lead particle size and distribution and physical property characteristics such as the tensile strength and hardness. The processing of the stock may be terminated with either a cold working step or an annealing operation as may be deemed appropriate. Also, it will be understood that the process may be initiated by first subjecting the cast stock to an annealing operation to improve its ductility during the first cold working step.

While this method has been described as including "cold" working of the stock, this terminology is to be understood as also including "warm" working. "Warm" working is contrasted to hot working where the copper-based alloy is normally heated to a temperature at which it is not liquified but is very soft and readily workable. "Warm" working can be described as having the temperature of the material maintained, or at, in the region where the lead or other low melting point constituents may become liquid or at least extremely plastic.

Figure 9:
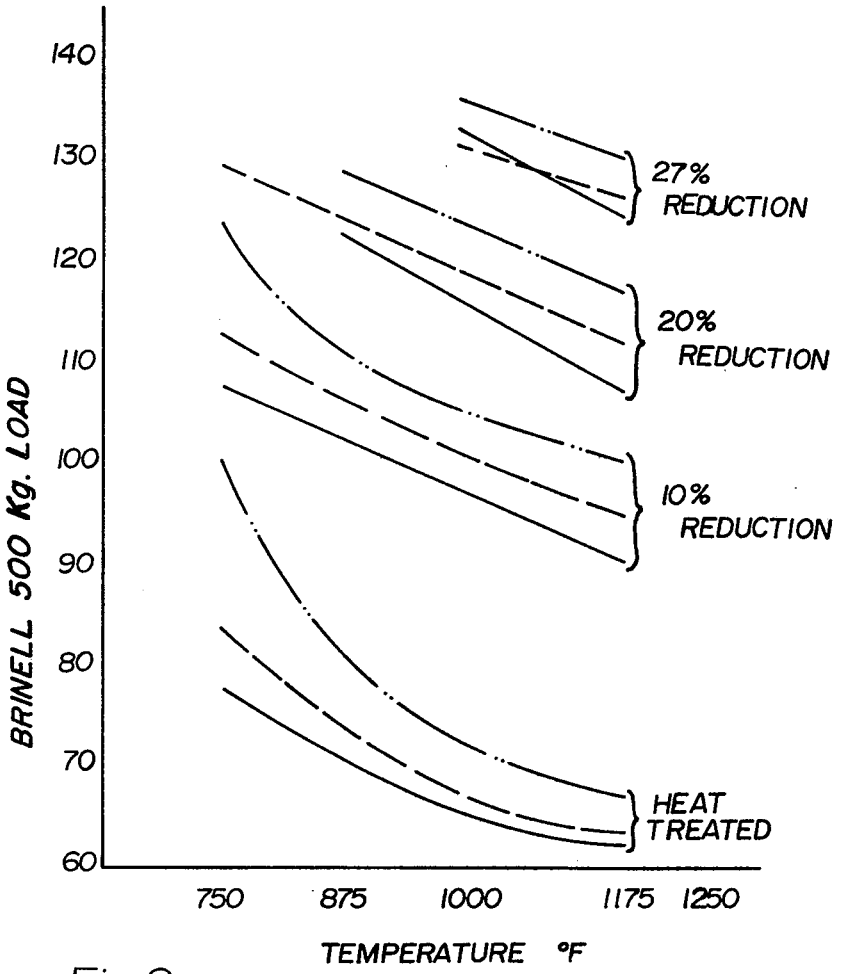
FIG. 9 is a graphical representation of the relationship between material hardness and annealing temperatures for various amounts of dimensional reduction or cold working.

The effect of the annealing operations is graphically illustrated in FIG. 9. This graph indicates the effect of annealing the material for various time periods and various temperatures, and the reduction in hardness that may be obtained. Also on this graph, the relationship of the cold working between annealing operations is illustrated to better correlate the effect of obtaining and controlling the resultant hardness of the material. This graph indicates that various degrees of hardness are obtained after certain specific steps in reduction are obtained through the cold working operations. The highest degree of cold working is indicated as 27%, however, this is only representative as greater or less reductions may be obtained with a particular material. The criteria which is considered in the degree of reduction as well as hardness includes the extend to which the material may be worked before destructive fracturing will occur. In some materials this fracturing will not occur until after exceeding a nominal 30% reduction in dimension and the total reduction before fracture may be of the order of 50–70%. The degree of cold working and fracturing are inter-related for a particular material and are to be considered in determining the extent to which the material may be worked.

Annealing temperatures may be in the range of 750°–1175° F. with 1250° F. being considered as the maximum upper limit. Annealing at temperatures above this maximum are not deemed beneficial to the method. It will be apparent from the graph of FIG. 9, that there is a relationship between the annealing temperature and the time during which the article is subjected to this temperature. In general, it is more advantageous to use the higher annealing temperatures as this tends to reduce the annealing time required to obtain recrystalization. Additionally, it will be noted that the extend of cold working is a factor determining the temperature and duration of application to effect the desired recrystalization. Specific temperatures will be dictated by the particular alloy composition and the instant references to temperatures is considered illustrative. It is to be understood that the annealing temperatures will be determined in accordance with practice and found most efficient for obtaining recrystalization after a cold working operation.

A copper-based alloy having a substantial lead constituent such as 5% or more has a grain structure as cast which is diagrammatically illustrated in FIG. 4 which is a cross sectional view of a cast plate that is intended to be ultimately formed into a bearing structure. This grain structure is characterized by having large size crystals 40 with the illustrated configuration being that for stock prior to processing in accordance with this invention. The lead is in solution with the molten copper-based alloy during the casting process and the lead tends to form into particles 41 generally concentrated near the center as a consequence of the solidification process. It is this grain structure that is usually evident in bearings fabricated by the prior practice of merely machining cast stock. It will be seen that such bearings are incapable of advantageously utilizing the lead as a lubricant since the greatest proportion of the lead particles 41 are located a distance inwardly of either of the surfaces of the plate. While a greater proportion of the lead particles may become available though machining away a substantial portion of the stock, this is not an economically feasible or practical procedure for obtaining the lubricative properties of the included lead content.

FIG. 4 is specifically illustrative of the grain structure for continuous cast plate but the large grain size and lead particle distribution is also typical of copper materials obtained by other casting procedures. This grain structure is not the most desired for bearings and a bearing's structural and performance characteristics are enhanced by application of the method of this invention to the cast plate resulting in a reduction in grain or crystal size to that diagrammatically illustrated in FIG. 8. This reduction is crystal size is accompanied by a more advantageous distribution and dispersion of the lead particles throughout the stock and it results in substantially increasing the amount of lead in the surface boundry regions thereby enhancing lubricative properties. Also, as previously noted, this reduction in crystal grain size results in a material increase in tensile strength and hardness which are important design criteria in many applications.

To demonstrate the advantageous results obtainable through utilization of the method of this invention in processing of a leaded bronze, a continuous cast plate of SAE 660 alloy was subjected to the alternate cold working and annealing steps. This test plate had a thickness of 0.56 inches, and a 4.0 inch width and a length of slightly over two feet. This plate was subjected to the inventive process and received a 75% reduction in thickness to 0.140 inch. In this procedure, the plate was subjected to cold working as the final step which increased hardness, although the final step could have been annealing if different particular properties had been specified. One particularly notable feature achieved by this mechanical thickness reduction was the obtaining of a plate that was thinner than what could be obtained by continuous casting. More importantly, a significant enhancement of physical properties was attained in the resultant plate. The tensile strength was increased from the as-cast of 35.7 kpsi to 57.0 kpsi and the Brinnel hardness increased from 73 to 114. This enhancement of properties clearly demonstrates the patentably novel utility of this inventive process in that a lead bronze material can now be provided having physical characteristics and properties that are significantly enhanced over the as-cast qualities and thus fills a need for a particular bronze alloy.

Figure 10:
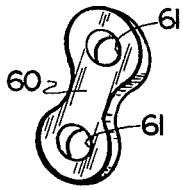
FIG. 10 is a perspective view of a specific shaped article fabricated in accordance with this invention.

The process of this invention is stated as primarily consisting of the alternate steps of cold working and annealing following initial fabrication of a stock or blank by a selected chill casting technique. Additionally, a further step in formation of articles can include the subsequent step of forming the article from a flat stock blank by a die-stamping operation. The utilization of a die stamping operation effects further economy in the formation of specifically shaped articles that may be of a relatively complex configuration in that the article itself may then be closely cut to the desired article configuration. As an example of such a procedure, FIG. 10 is referred to wherein an article 60 having a Figure. 8 shape is stamped out of a flat stock having a predetermined thickness. The article, as thus stamped out, is nearly finished and if necessary only a slight amount of machining may be required to smooth the flat surfaces or to either finish smoothing planar surfaces or to more accurately size the diameter of the holes 61 that are punched therein. The process of this invention employing alternate cold working and annealing steps enables a leaded bronze to be die stamped whereas the same material in an as-cast condition would most likely be fractured or ruptured to such an extent as to be unusable after die stamping. The stamping procedure also tends to further enhance the characteristics and properties of the finished article since the stamping also constitutes a further cold working procedural step. There is a cold working of the flat stock through the effect of clamping the stock between opposing faces of the stamping die with subsequent further cold working achieved by the actual die cutting components in severing the piece from the stock. This working thus will increase the hardness of the article and, in certain instances, it may be desirable to again subject the article to an annealing step to obtain recrystallization and a resultant hardness in accordance with the specifications for the particular article.

The preceding description has been directed primarily to the forming of articles from leaded bronze intended for utilization in bearing structures. This description has been by way of example only and it will be understood that articles having utilization other than as bearings, are also intended to be produced and formed by this same process and achieve the same advantageous results and improvements. It will be recognized that many articles are preferably formed from a leaded bronze or a bronze material for other specific reasons, however, it is necessary that the article have specific minimum characteristics of structural strength and hardness to be employed in such instances. Utilization of the process of this invention enables formation of such articles with a greater economy than could be otherwise achieved through the necessity of performing expensive machining operations on leaded bronze materials that cannot otherwise be simply cold worked. Accordingly, it will be noted that the process is equally applicable to formation of articles where it is only desired that the article have the properties and characteristics of a material similar to that which is used for a bearing. It will also be seen that the specific reference to formation of bearing structures is only illustrative and suggests the much broader application of the process in effecting economies in manufacturing procedures as well as obtaining a materially enhanced article for a particularly specified purpose.

A still further advantage in the utilization of the leaded bronzes which are rendered capable of such processing by this invention, is the reduction in the actual raw material costs of the constituents of these leaded bronzes. Heretofore, when it was desired to achieve a material with high structural strength and hardness, this was achieved through the increase in the proportional amount of tin that was included in the alloy. This often resulted in a requirement for inclusion of tin to the extent of the order of 12% to achieve the specified hardness and structural strength properties and characteristics. Tin, however, is a very expensive element and thus the cost of the article must necessarily be proportionally increased. In accordance with the process of this invention, the amount of tin that is required to achieve a specific structural strength can be significantly reduced through the substitution of lead for a substantial proportion thereof. As an example, it has been found that lead may be substituted for 6 to 8% of the tin in maintaining the same required hardness and structural strength; but, lead has raw material costs of only about one twenty-fifth that of tin. Accordingly, it will be seen that a substantial saving can be effected through the utilization of lead as a substitute for a substantial portion of the previously required tin while attaining the same specified strength and hardness.

Maintaining a minimum amount of tin is important in materials that are utilized where lead is to be incorporated in that the tin acts as a wetting agent causing the lead to better flow with respect to the copper based alloy. However, the effect of the tin in obtaining the wetting action is only noticed and of consequence up to the addition of 3% tin. Exceeding 3% tin does not further aid in achieving the wetting characteristic and consequently, the further addition of tin only represents a substantial increase in the material cost. Consequently, substitution of the lead for the tin in excess of the requirement of 3% is effective in obtaining the necessary and prescribed structural strength and hardness for the finished article.

From the preceding description of the process of this invention, it will be readily apparent that a novel and advantageous process is provided for processing of copper-based alloys having a substantial lead component. This process enables fabrication of bearings or other articles from leaded bronze or similar type materials having substantially improved and smaller grain structure and enhanced physical properties, specifically tensile strength and hardness. The bearings thus fabricated, in the case of leaded bronze, have a more uniform distribution and dispersion of the lead particle for improved self-lubrication characteristic. Accurate control of the cold working steps and annealing steps permits precise control of the physical properties in the end product to achieve a material having particular specified characteristics. One other important advantage of this technique is that it is now possible to modify commercially available bronzes to obtain a material having properties not otherwise available and thus fills a particular need for materials having specific characteristics and to effect substantial economy in the fabrication from such materials.

Having thus described this invention, what is claimed is:

1. A method of forming bearing articles from chill-cast high lead bronze alloy having low melting point constituents including lead which is in the proportion of at least 4% comprising the steps of alternatingly (A) mechanically cold working a casting of the lead bronze alloy to effect a predetermined dimensional reduction, up to 30 percent to avoid fracturing and (B) annealing the casting of the lead bronze alloy at a predetermined temperature for a predetermined period of time to increase the alloy's ability to be worked into a bearing configuration and affect mechanical properties of the alloy such as tensile strength and hardness.

2. The method of claim 1 in which the casting is subjected to at least two cold working steps each effecting a respective predetermined dimensional reduction and the casting is subjected to an annealing step intermediate each two consecutive cold working steps.

3. The method of claim 2 in which the last cold working step effects a predetermined dimensional reduction to increase the hardness to a predetermined value.

4. The method of claim 1 in which the casting is subjected to at least two annealing steps and is subjected to a cold working step intermediate each two annealing steps.

5. The method of claim 4 in which the last annealing step effects a reduction in hardness to a predetermined value.

6. The method of claim 1 in which the casting is first subjected to an annealing step.

7. The method of claim 1 in which the casting is first subjected to a cold working step.

8. The method of claim 1 in which the casting is subjected to a plurality of alternated cold working and annealing steps to thereby reduce the crystaline structure to a predetermined grain size and to distribute particles of lead substantially uniformly throughout the casting.

9. The method of claim 1 in which the casting is annealed at a temperature within the range of 750°–1250° F.

10. The method of claim 9 in which the casting is annealed for a period of time with the range of 1–12 hours.

11. The method of claim 1 which includes the step of forming the article casting by a chill casting technique with the rate of cooling the casting controlled to a predetermined rate to effect control of grain size to within a predetermined size range and control of matrix configuration.

* * * * *